US010821328B2

(12) United States Patent
Huang

(10) Patent No.: US 10,821,328 B2
(45) Date of Patent: Nov. 3, 2020

(54) EXERCISE BALL

(71) Applicant: Industro International Co., Ltd., Taichung (TW)

(72) Inventor: Kuo-Chan Huang, Taichung (TW)

(73) Assignee: Industro International Co., Ltd., Taichung (TW)

( * ) Notice: Subject to any disclaimer, the term of this patent is extended or adjusted under 35 U.S.C. 154(b) by 130 days.

(21) Appl. No.: 16/160,541

(22) Filed: Oct. 15, 2018

(65) Prior Publication Data

US 2020/0114220 A1 Apr. 16, 2020

(51) Int. Cl.
*A63B 43/00* (2006.01)
*A61H 1/00* (2006.01)

(52) U.S. Cl.
CPC ..... *A63B 43/002* (2013.01); *A61H 1/00* (2013.01); *A63B 2208/0228* (2013.01)

(58) Field of Classification Search
CPC ..... A63B 21/0004; A63B 21/00058; A63B 21/00061; A63B 21/00065; A63B 21/00069; A63B 21/00072; A63B 21/00185; A63B 21/005; A63B 21/0058; A63B 21/0059; A63B 21/02; A63B 21/026; A63B 21/027; A63B 21/04; A63B 21/0407; A63B 21/0414; A63B 21/0421; A63B 21/0428; A63B 21/0435; A63B 21/0442; A63B 21/045; A63B 21/0455; A63B 21/05; A63B 21/055; A63B 21/0552; A63B 21/0555; A63B 21/0557; A63B 21/06; A63B 21/0604; A63B 21/0607; A63B 21/065; A63B 21/068; A63B 21/072; A63B 21/0722; A63B 21/0724; A63B 21/0726; A63B 21/0728; A63B 21/075; A63B 21/08; A63B 21/15; A63B 21/159; A63B 21/22; A63B 21/4017; A63B 21/4019; A63B 21/4021; A63B 21/4023; A63B 21/4025; A63B 21/4027; A63B 21/4033; A63B 21/4035; A63B 21/4039; A63B 21/4043; A63B 23/12; A63B 23/1209; A63B 23/1245; A63B 23/1281; A63B 23/14; A63B 23/16; A63B 24/0087; A63B 39/00; A63B 39/06; A63B 39/08; A63B 43/00; A63B 43/002; A63B 43/02; A63B 43/04; A63B 71/0054; A63B 71/0619; A63B 71/0622; A63B 2071/0063; A63B 2071/0072; A63B 2071/0081; A63B 2072/009; A63B 2072/0625; A63B 2071/0655; A63B 2208/00; A63B 2208/0228; A63B 2225/09; A63B 2225/093; A61H 1/00
See application file for complete search history.

(56) References Cited

U.S. PATENT DOCUMENTS 2,177,878 A * 10/1939 Savage ..... A63H 1/06 446/153
2,836,009 A * 5/1958 Wang ..... A63B 67/16 446/242

(Continued)

*Primary Examiner* — Gary D Urbiel Goldner

(57) ABSTRACT

An exercise ball includes a spherical cage and a sphere. The spherical cage includes two opposite openings. The sphere includes two opposite convex portions formed thereon. The sphere is inserted in the spherical cage and the convex portions are inserted in the openings to keep the sphere in the spherical cage.

6 Claims, 6 Drawing Sheets

(56) References Cited

U.S. PATENT DOCUMENTS 3,580,575 A * 5/1971 Speeth ..... A63B 43/06 473/570
3,673,362 A * 6/1972 Carlson ..... H01H 35/142 200/61.45 R
4,184,682 A * 1/1980 Collins ..... A63B 65/00 473/596
5,267,921 A * 12/1993 Roehlk ..... A63B 21/0455 482/126
5,413,332 A * 5/1995 Montgomery ..... A63B 43/002 473/570
5,496,026 A * 3/1996 Montgomery ..... A63B 43/002 473/570
5,580,336 A * 12/1996 Coallier ..... A63B 23/03533 473/614
5,725,445 A * 3/1998 Kennedy ..... A63B 43/06 473/570
6,802,758 B2 * 10/2004 Somers ..... A63H 1/10 446/242
7,114,688 B2 * 10/2006 Rudolf ..... F16C 11/0619 248/278.1
7,976,443 B2 * 7/2011 Krull ..... A63B 21/0728 482/108
8,033,965 B1 * 10/2011 Krull ..... A63B 21/075 482/107
8,608,627 B2 * 12/2013 Ross ..... A63B 21/072 482/108
9,149,695 B2 * 10/2015 Evans ..... A63B 65/122
9,630,076 B2 * 4/2017 Evans ..... A63B 43/002
9,907,720 B2 * 3/2018 Kuhne ..... A61H 1/008
10,470,518 B1 * 11/2019 Walsh ..... A01D 7/06
10,583,320 B2 * 3/2020 Schranz ..... A63B 21/159
2004/0079849 A1 * 4/2004 Rudolf ..... F16M 11/2092 248/276.1
2009/0314221 A1 * 12/2009 Wang ..... A01K 15/025 119/707
2014/0144417 A1 * 5/2014 Evans ..... A63B 67/183 124/5
2015/0297964 A1 * 10/2015 Evans ..... A63B 37/0011 473/513
2016/0096093 A1 * 4/2016 Evans ..... A63B 37/0011 473/513
2018/0326255 A1 * 11/2018 Schranz ..... A63B 21/025

* cited by examiner

EXERCISE BALL

BACKGROUND OF INVENTION

1. Field of Invention

The present invention relates to an exercise apparatus and, more particularly, to an exercise ball with which a person can exercise.

2. Related Prior Art

As disclosed in US Patent Publication No 2017/0106249, a vibrating fitness ball 100 is a hollow sphere consisting of two hemi-spheres 110 and 112. The sphere 100 contains a circuit board assembly 220, a battery assembly 260, a motor 150 and two eccentric masses 152 and 154. The battery assembly 260 provides electricity to the circuit board assembly 220. The circuit board assembly 220 is electrically connected to the motor 150 so that the former controls the speed of rotation of a shaft 156 of the latter. The eccentric masses 152 and 154 are eccentrically connected to two opposite ends of the shaft 156. Thus, the sphere 100 is vibrated by the eccentric masses 152 and 154 when the eccentric masses 152 and 154 are rotated by the mandrel.

As disclosed in European Design Patent No. 003744119-0001 and Korean Patent No. 30-0908055, an exercise ball looks like a peanut.

The present invention is therefore intended to obviate or at least alleviate the problems encountered in prior art.

SUMMARY OF INVENTION

It is the primary objective of the present invention to provide an exercise ball that can be used alone or in connection with another identical exercise ball.

To achieve the foregoing objective, the exercise ball includes a spherical cage and a sphere. The spherical cage includes two opposite openings. The sphere includes two opposite convex portions formed thereon. The sphere is inserted in the spherical cage. The sphere is inserted in the spherical cage and the convex portions are inserted in the openings to keep the sphere in the spherical cage.

The present invention will be described via detailed illustration of the preferred embodiment referring to the drawings wherein.

BRIEF DESCRIPTION OF DRAWINGS

The present invention will be described via detailed illustration of four embodiments referring to the drawings wherein.

DETAILED DESCRIPTION OF EMBODIMENTS

Figure 1:
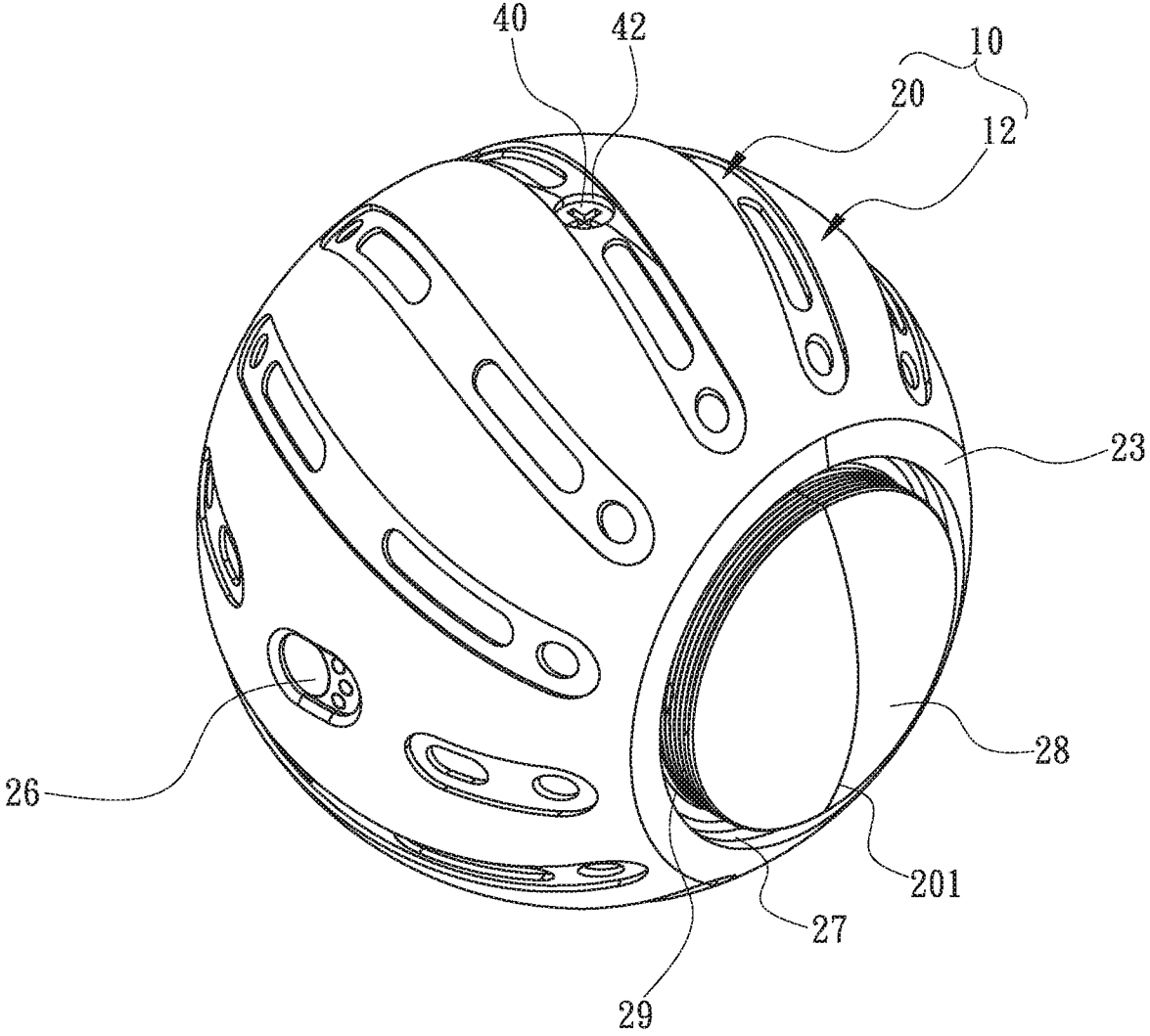
FIG. 1 is a perspective view of an exercise ball according to the first embodiment of the present invention.

Referring to FIG. 1, an exercise ball 10 is hollow sphere according to a first embodiment of the present invention. A user can exercise with the exercise ball 10 by holding and lifting the exercise ball 10. Alternatively, a user can message his or her muscles in the neck, the shoulders, the waist, the arms and the legs, and around joints.

Figure 2:
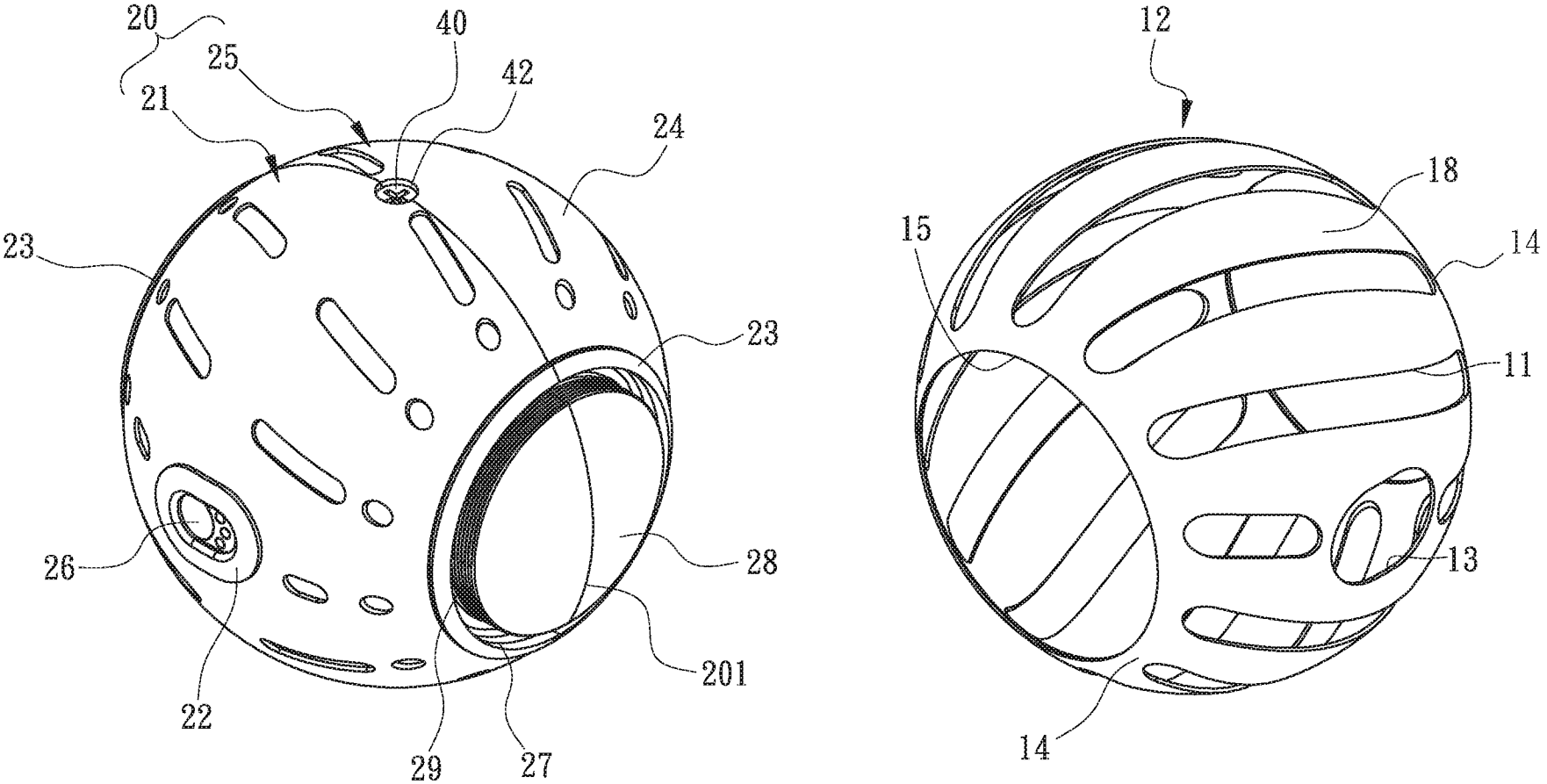
FIG. 2 is an exploded view of the exercise ball shown in FIG. 1.

Referring to FIGS. 1 and 2, the exercise ball 10 includes a spherical cage 12 and a hollow sphere 20 in accordance with the first embodiment of the present invention. The spherical cage 12 wraps, protects and/or decorates the sphere 20. The spherical cage 12 and the sphere 20 are made of different materials. The spherical cage 12 is made of a relatively elastic material and the sphere 20 is made of a relatively rigid material. Thus, the spherical cage 12 provides a nice touch to a user and the sphere 20 contains and protects other components to be described later. For example, injection molding is used to provide the material of the spherical cage 12 over the sphere 20. Then, the material of the spherical cage 12 cools and cures and the spherical cage 12 covers the sphere 20.

Preferably, the spherical cage 12 includes several connective strips 18 formed between and connected to two annular strips 14. The connective strips 18 are separated from one another by slots 11. Each of the connective strips 18 extends in a helical manner, and so does each of the slots 11. A bore 13 is made in a sheet (not numbered) that is formed between two and connected to adjacent ones of the connective strips 18. An opening 15 is made in each of the annular strips 14.

The sphere 20 includes an O-shaped protuberance 22, two convex portions 23, a recess 24, two annular grooves 27, two extensive portions 28 and two circular cavities 42. The O-shaped protuberance 22 extends around a bore (not numbered) made in the sphere 20. The convex portions 23 are located at two opposite portions of the sphere 20. The convex portions 23 extend in an annular manner. The recess 24 is made in a major portion of the external face of the sphere 20 except for the convex portions 23. The extensive portions 28 are formed at two ends of a diameter of the sphere 20. Each of the convex portions 23 extends around a corresponding one of the extensive portions 28. Each convex portion 23 is separated from the corresponding extensive portion 28 by corresponding one of the annular grooves 27. Each of the extensive portions 28 is formed with a thread 29.

The recess 24 receives the spherical cage 12 when the sphere 20 is inserted in the spherical cage 12. To this end, the depth of the recess 24 is about the thickness of the spherical cage 12. Now, the convex portions 23 are inserted in the openings 15, and the O-shaped protuberance 22 is inserted in the bore 13, thereby preventing rotation of the sphere 20 relative to the spherical cage 12.

Figure 3:
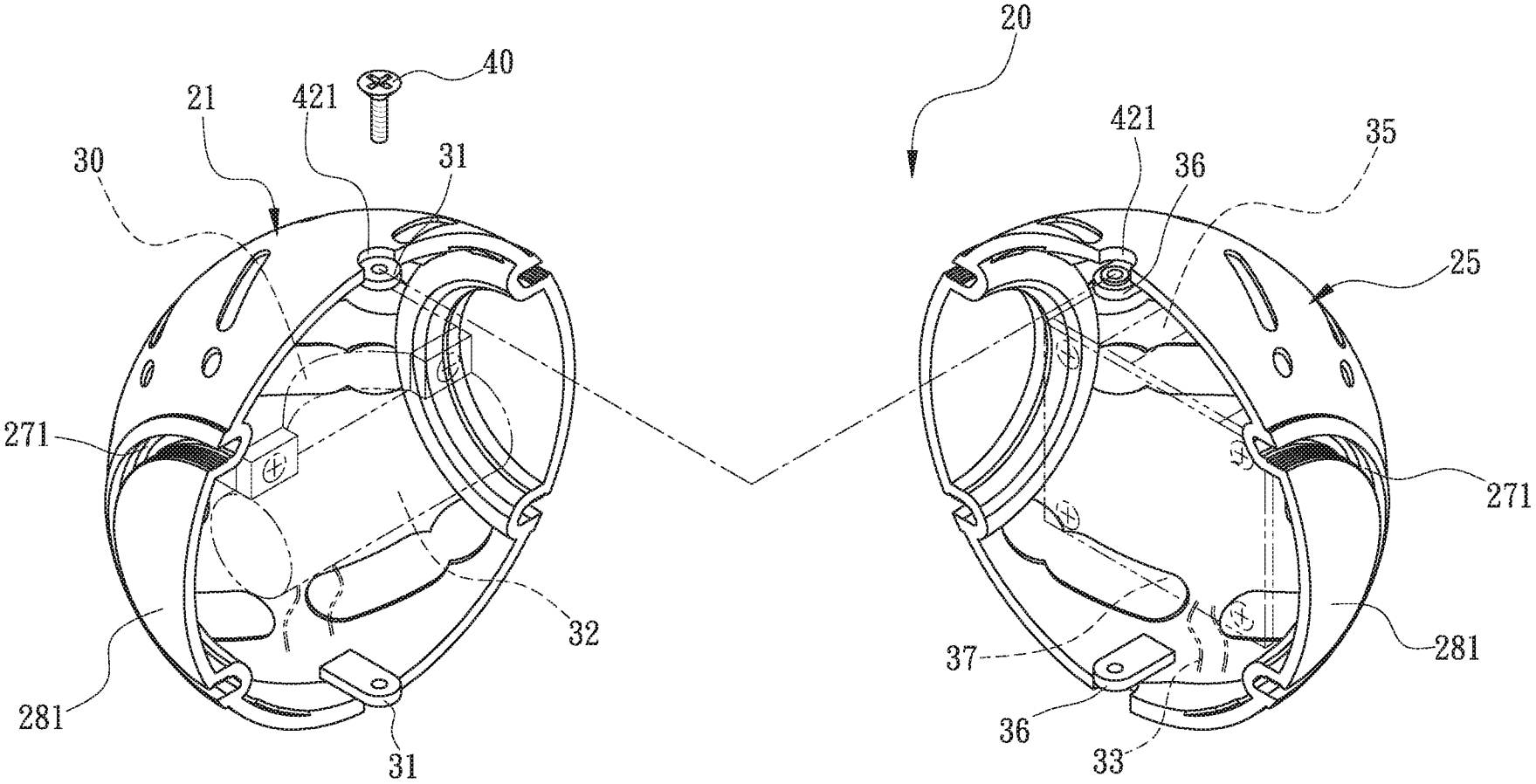
FIG. 3 is an exploded view of a sphere of the exercise ball shown in FIG. 2.

Referring to FIGS. 2 and 3, the sphere 20 consists of two hemispheres 21 and 25 that are separately made and then interconnected. Naturally, there is a gap 201 between the hemispheres 21 and 25.

Preferably, the O-shaped protuberance 22 is formed on the hemisphere 21. However, the O-shaped protuberance 22 can consist of two C-shaped protuberances each of which is formed on a corresponding one of the hemispheres 21 and 25 in another embodiment. A socket (not shown) can be provided on the hemisphere 21, in the O-shaped protuberance 22.

Preferably, each of the convex portions 23 consists of two semi-circular portions each of which is formed on a corresponding one of the hemispheres 21 and 25. However, in another embodiment, one of the convex portions 23 can be formed on the hemisphere 21, and the remaining convex portion 23 on the hemisphere 25.

Preferably, each of the extensive portions 28 consists of two semi-circular portions 281 each of which is formed on a corresponding one of the hemispheres 21 and 25. However, in another embodiment, one of the extensive portions 28 can be formed on the hemisphere 21, and the remaining extensive portion 28 on the hemisphere 25.

Preferably, each of the annular grooves 27 consists of two semi-circular grooves 271 each of which is formed on a corresponding one of the hemispheres 21 and 25. However, in another embodiment, one of the annular grooves 27 can be made in the hemisphere 21, and the remaining annular groove 27 in the hemisphere 25.

Each of the circular cavities 42 preferably consists of two semi-circular cavities 421 each of which is made in a corresponding one of the hemispheres 21 and 25. The hemisphere 21 includes two lugs 31 near the semi-circular cavities 421. The hemisphere 25 includes two lugs 36 near the semi-circular cavities 421. The lugs 31 are overlapped with the lugs 36 when the hemispheres 21 and 25 are joined together. A screw 40 is inserted in each pair of overlapped lugs 31 and 36 to keep the hemispheres 21 and 25 joined together.

The hemisphere 21 includes a support unit 30 that includes several claws (not numbered) extending from an internal face of the hemisphere 21. The hemisphere 25 includes a support unit 35 that includes several claws (not numbered) extending from an internal face of the hemisphere 25.

The support unit 30 holds a vibration unit 32, and the support unit 35 holds a control unit 37. The support unit 30 or 35 can further hold at least one battery (not shown). The battery is electrically connected to the control unit 37 via a pair of wires 33. The vibration unit 32 is electrically connected to the control unit 37 via another pair of wires 33. The battery is preferably a rechargeable battery. The vibration unit 32 is used to produce a simple harmonic motion to vibrate the sphere 20. The control unit 37 is electrically connected to a switch 26 (FIG. 2) by another pair of wires (not shown). The switch 26 is exposed to the exterior of the sphere 20 via the bore around which the O-shaped protuberance 22 extends.

Figure 4:
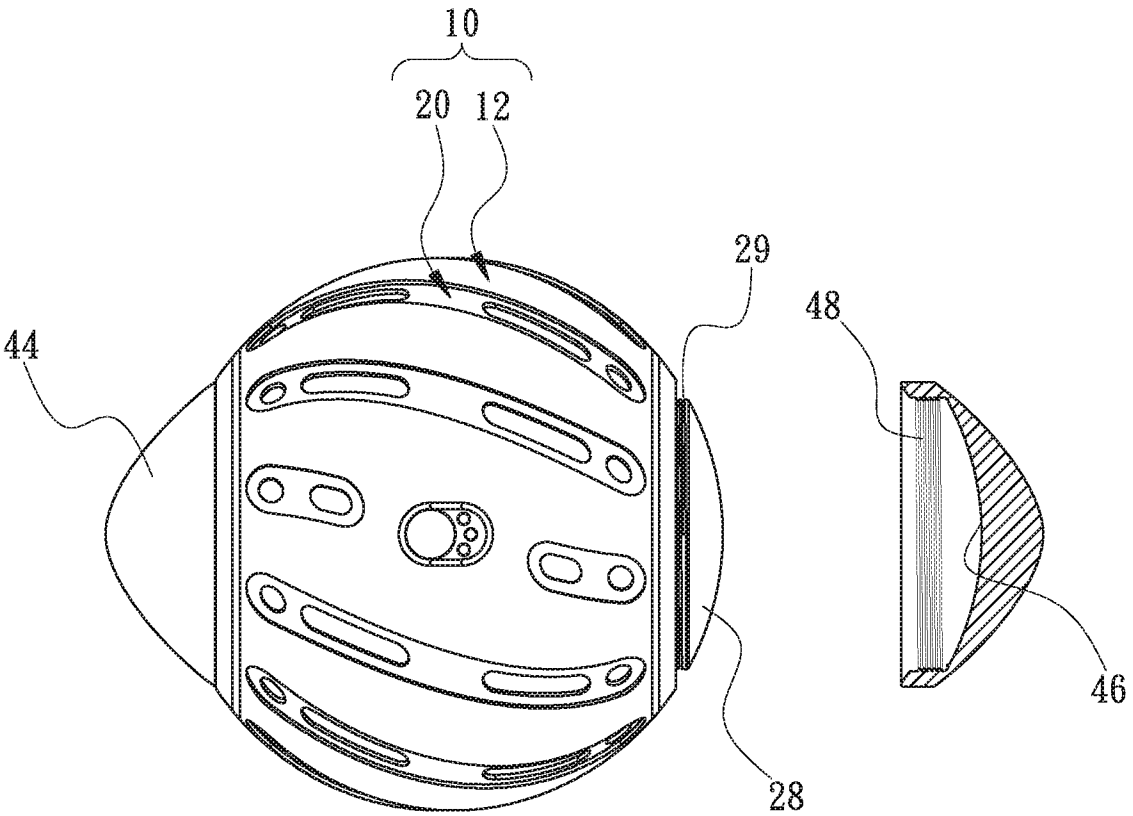
FIG. 4 is an exploded view of an exercise ball according to the second embodiment of the present invention.

Referring to FIG. 4, there is an exercise ball 10 according to a second embodiment of the present invention. The second embodiment is identical to the first embodiment except for additionally including two decorations 44. Each of the decorations 44 is a conical that includes a conical space 46 and a thread 48 formed on an internal face thereof. When the decorations 44 are inserted in the annular grooves 27 (FIG. 2), the decorations 44 receive the extensive portions 28. The threads 48 are engaged with the threads 29 to connecting the decorations 44 to the sphere 20. Thus, the exercise ball 10 is made. Now, the exercise ball 10 is an oval form and protected by the spherical cage 12.

Figure 5:
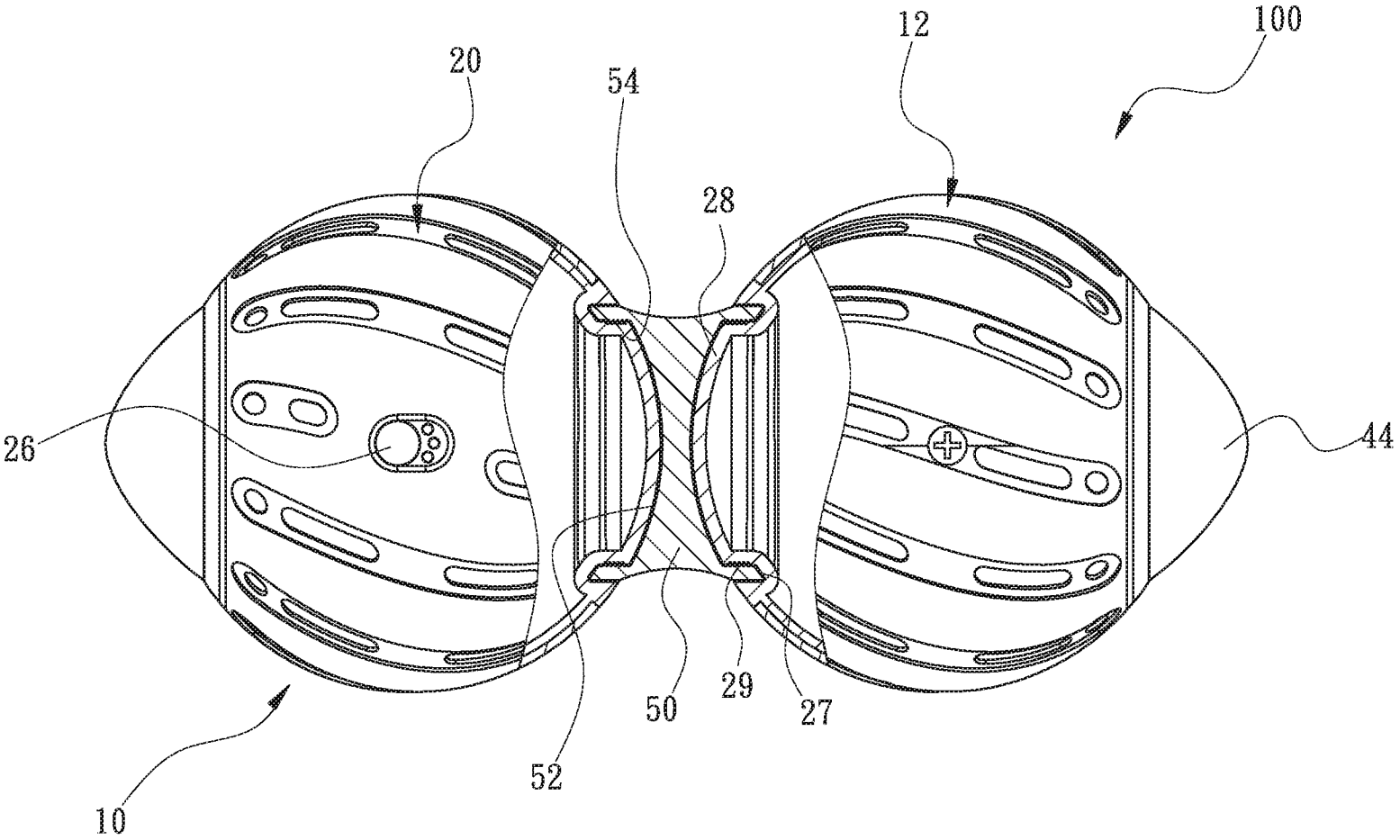
FIG. 5 is a cut-away view of an exercise ball according to the third embodiment of the present invention.

Referring to FIG. 5, there is an exercise apparatus 100 according to a third embodiment of the present invention. The exercise apparatus 100 includes two exercise balls 10 as described in relation to the first embodiment, two decorations 44 as described in relation to the second embodiment, and a joint 50. The joint 50 includes two spaces 52 located opposite to each other. A thread 54 is formed on a wall of each of the spaces 52. Each end of the joint 50 is inserted in one of the annular grooves 27 of one of the exercise balls 10. Each of the spaces 52 receives one of the extensive portions 28 of one of the exercise balls 10. Each of the threads 54 is engaged with one of the threads 29 of one of the exercise balls 10. Thus, the exercise balls 10 are joined together by the joint 50. Now, the exercise apparatus 100 looks like a dumbbell. Each of the decorations 44 is connected one of the extensive portions 28 of one of the exercise balls 10.

Figure 6:
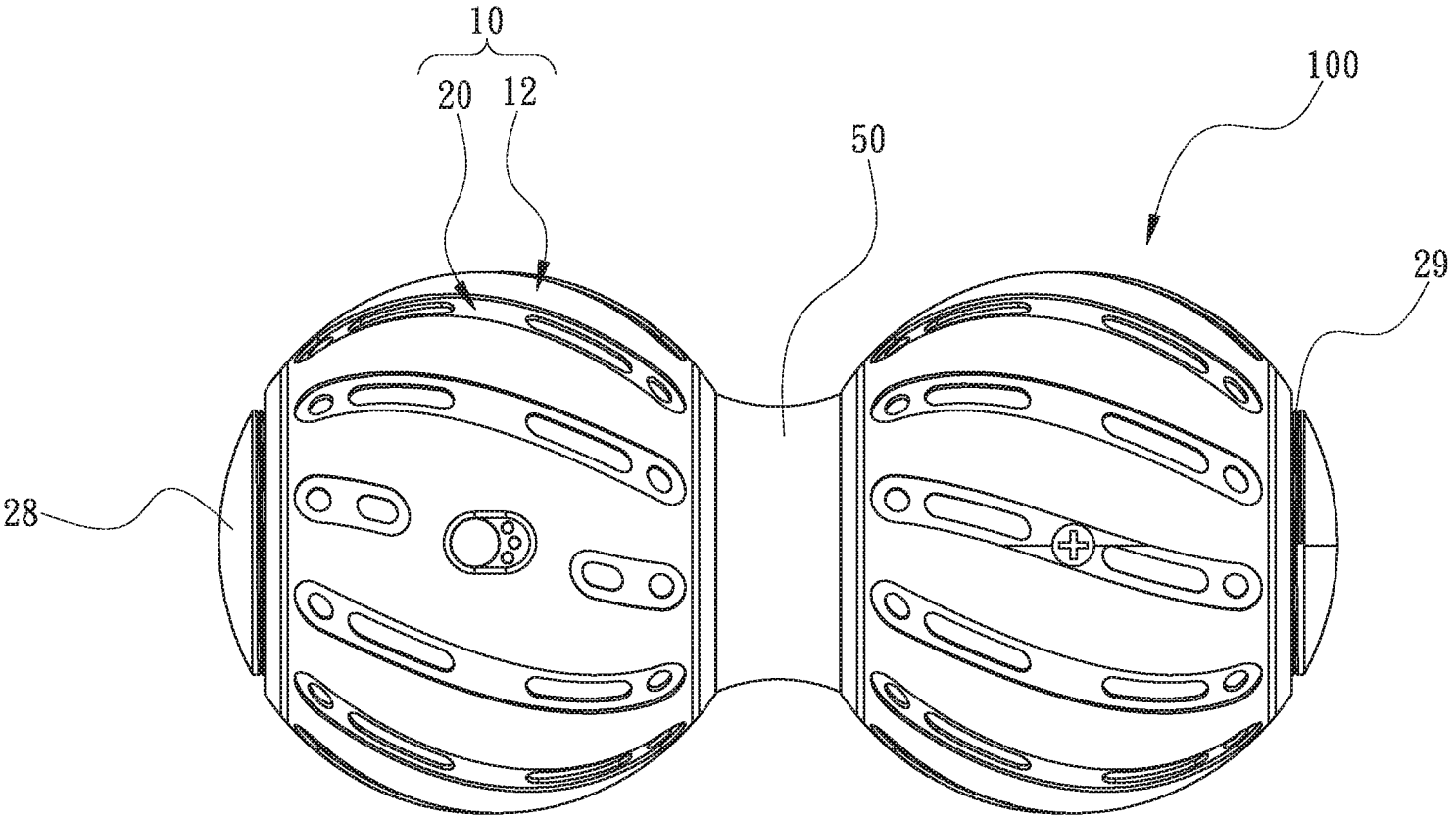
FIG. 6 is a side view of an exercise ball according to the fourth embodiment of the present invention.

Referring to FIG. 6, there is an apparatus 100 according to a fourth embodiment of the present invention. The fourth embodiment is identical to the third embodiment except for omitting the decorations 44.

The present invention has been described via the illustration of the embodiments. Those skilled in the art can derive variations from the embodiments without departing from the scope of the present invention. Therefore, the embodiments shall not limit the scope of the present invention defined in the claims.

The invention claimed is:

1. An exercise ball comprising:
- a spherical cage comprising two opposite openings;
- a sphere comprising:
  - two extensive portions respectively formed at two opposite ends of a diameter of the sphere;
  - two opposite convex portions each of which extends around a corresponding one of the extensive portions; and
  - two annular grooves each of which extends between a corresponding one of the convex portions and a corresponding one of the extensive portions, wherein the sphere is inserted in the spherical cage and the convex portions are inserted in the openings to keep the sphere in the spherical cage; and
- two decorations respectively connected to the extensive portions in the annular grooves.

2. The exercise ball according to claim 1, wherein each of the decorations comprises a space for receiving the corresponding extensive portion when the decoration is inserted in the corresponding annular groove.

3. The exercise ball according to claim 2, wherein each of the decorations comprises a first thread formed on a wall of the space, wherein each of the extensive portions comprises a second thread engaged with the first thread of the corresponding decoration.

4. An exercise apparatus comprising:
- two exercise balls each of which comprises:
  - a spherical cage comprising two opposite openings; and
  - a sphere comprising:
    - two extensive portions respectively formed at two opposite ends of a diameter of the sphere;
    - two opposite convex portions each of which extends around a corresponding one of the extensive portions; and
    - two annular grooves each of which extends between a corresponding one of the convex portions and a corresponding one of the extensive portions, wherein the sphere is inserted in the spherical cage and the convex portions are respectively inserted in the openings to keep the sphere in the spherical cage; and
- a joint comprising two ends each of which is connected to one of the extensive portions of one of the spheres.

5. The exercise apparatus according to claim 4, wherein the joint comprises two spaces for respectively receiving the extensive portions of the spheres when the ends of the joint are respectively inserted in the annular grooves of the spheres.

6. The exercise ball according to claim 5, wherein the joint further comprises two first threads each of which is formed on a wall of a corresponding one of the spaces, wherein each of the extensive portions comprises a second thread engaged with a corresponding one of the first threads of the joint.

* * * * *